US012117251B2

(12) United States Patent
Lee et al.

(10) Patent No.: US 12,117,251 B2
(45) Date of Patent: Oct. 15, 2024

(54) HEAT EXCHANGER

(71) Applicant: Hanon Systems, Daejeon (KR)

(72) Inventors: Wonteak Lee, Daejeon (KR); Sung Hong Shin, Daejeon (KR); Woo Jae Jeon, Daejeon (KR)

(73) Assignee: Hanon Systems, Daejeon (KR)

( * ) Notice: Subject to any disclaimer, the term of this patent is extended or adjusted under 35 U.S.C. 154(b) by 222 days.

(21) Appl. No.: 17/797,010

(22) PCT Filed: Feb. 17, 2021

(86) PCT No.: PCT/KR2021/002045
§ 371 (c)(1),
(2) Date: Aug. 2, 2022

(87) PCT Pub. No.: WO2021/167355
PCT Pub. Date: Aug. 26, 2021

(65) Prior Publication Data

US 2023/0068291 A1 Mar. 2, 2023

(30) Foreign Application Priority Data

Feb. 19, 2020 (KR) ..... 10-2020-0020234
Feb. 10, 2021 (KR) ..... 10-2021-0019420

(51) Int. Cl.

| | |
|---|---|
| ***F28F 1/00*** | (2006.01) |
| ***F28D 1/053*** | (2006.01) |
| ***F28D 21/00*** | (2006.01) |
| ***F28F 9/02*** | (2006.01) |

(52) U.S. Cl.
CPC ..... *F28F 9/0251* (2013.01); *F28D 1/05366* (2013.01); *F28D 21/00* (2013.01); *F28D 2021/0068* (2013.01)

(58) Field of Classification Search
CPC .... F28F 9/0251; F28D 1/05366; F28D 21/00; F28D 2021/0068
USPC ..... 165/177
See application file for complete search history.

(56) References Cited

U.S. PATENT DOCUMENTS

| | | | |
|---|---|---|---|
| 5,911,274 | A | 6/1999 | Inaba et al. |
| 2001/0010263 | A1 | 8/2001 | Ichiyanagi |
| 2005/0268645 | A1 | 12/2005 | Kent et al. |

FOREIGN PATENT DOCUMENTS

| | | | |
|---|---|---|---|
| DE | 69201143 | T2 | 5/1995 |
| DE | 102012105481 | A1 | 5/2013 |
| JP | 2000-227296 | A | 8/2000 |
| JP | 2007155168 | A | 6/2007 |
| KR | 97-0000671 | A | 1/1997 |
| KR | 100368544 | B1 * | 4/2003 |

(Continued)

OTHER PUBLICATIONS

German Examination Report issued on Mar. 15, 2024 in corresponding application No. 11 2021 000 295.3, with English translation.

*Primary Examiner* — Davis D Hwu
(74) *Attorney, Agent, or Firm* — Norton Rose Fulbright US LLP; James R. Crawford

(57) ABSTRACT

The present invention relates to a heat exchanger wherein a flat joining portion is formed on a tank, whereby a flange can be easily coupled to the inlet and outlet of the tank, the process of manufacturing the tank can be simplified, and the degree of shape freedom of the tank can be ensured.

23 Claims, 12 Drawing Sheets

(56) References Cited

FOREIGN PATENT DOCUMENTS

| | | | |
|---|---|---|---|
| KR | 2003-0075057 | A | 9/2003 |
| KR | 101186115 | B1 | 9/2012 |
| KR | 101518205 | B1 | 5/2015 |

* cited by examiner

HEAT EXCHANGER

CROSS REFERENCE TO RELATED APPLICATIONS

This application is a national phase under 35 U.S.C. § 371 of International Application No. PCT/KR2021/002045 filed on Feb. 17, 2021, which claims the benefit of priority from Korean Patent Application Nos. 10-2020-0020234 filed on Feb. 19, 2020 and 10-2021-0019420 filed on Feb. 10, 2021. The entire contents of these applications are incorporated herein by reference in their entirety.

TECHNICAL FIELD

The present invention relates to a heat exchanger, and more particularly, to a heat exchanger in which a flat coupling surface is formed on a tank to which a flange is coupled, so that coupling between the tank and the flange and processing of the flange are easy.

BACKGROUND ART

In a heat exchanger C of a related art, a tank 10 has a curved shape to have sufficient durability against internal pressure, and thus, a coupling surface of a flange 20 coupled to a refrigerant inlet or refrigerant outlet of the tank 10 should have a curved shape to correspond thereto as shown in FIG. 1.

However, in order to make the coupling surface of the flange 20 coupled to the tank 10 be a curved shape, a separate cutting process of processing the coupling surface of the flange 20 to be curved is required, and if the tolerance of the coupling surface of the tank 10 and the coupling surface of the flange 20 is not sufficiently managed, delamination occurs, so that it is not easy to braze the tank 10 and the flange 20, and as shown in FIG. 2, when the flange 20 is manufactured through a process of manufacturing a molded product 30 in which a curved coupling surface 31 is formed through extrusion and then cutting and machining the molded product 30 according to a size of the flange 20, the curved coupling surface 31 should be formed on one surface of the flange 20 during an extrusion process, and thus, processing of a shape of the molded product 30 is limited to make the flange large and heavy.

PATENT DOCUMENT

Korean Patent Registration No. 1518205 (Apr. 30, 2015).

DISCLOSURE

Technical Problem

An object of the present invention is to provide a heat exchanger capable of more easily brazing a tank and a flange.

Another object of the present invention is to provide a heat exchanger in which a manufacturing process of a flange coupled to a tank is simplified.

Another object of the present invention is to provide a heat exchanger in which a shape of a flange coupled to a tank is optimized in a molding process through extrusion or forging.

Technical Solution

In one general aspect, a heat exchanger includes: a core including a plurality of tubes in which a heat exchange medium flows; a pair of headers provided on both sides of the core, each having a tube insertion hole and fluidly coupled to the plurality of tubes through the tube insertion hole; and a pair of tanks coupled to the pair of headers, respectively, to form a pair of header tanks, wherein one side tank of the pair of header tanks includes an inlet through which the heat exchange medium flows into the one side tank and an outlet through which the heat exchange medium is discharged from the one side tank, and at least one of the inlet and the outlet may have a flat joining portion in which an outer wall of the one side tank has a flat shape.

The heat exchanger may further include a flange coupled to the inlet or the outlet on which the flat joining portion is formed, wherein the flange may include a tank joining portion joined to the inlet or the outlet, and the tank joining portion may have a flat shape corresponding to the flat joining portion.

The flat joining portion of the one side tank may be formed to be concave toward a header coupled to the one side tank, rather than an outer wall of the one side tank in a remaining region, except for the flat joining portion, in the one side tank.

The flange may include a pipe insertion portion into which a pipe is inserted, and the pipe insertion portion may be formed in a direction in which the flange is extruded or forged.

The flange may further include a screw coupling portion to which a screw is coupled, and the screw coupling portion may be formed in a direction in which the flange is extruded or forged.

The flange may have a structure in which one longitudinal side in which the pipe insertion portion is formed protrudes relative to the other longitudinal side in which the screw coupling portion is formed.

The flange may include a blocking portion closing one longitudinal side of the screw coupling portion facing the flat joining portion.

The flange may further include a connection insertion portion communicating with the pipe insertion portion and passing through the flange.

An inner diameter of the connection insertion portion may be formed to be smaller than an inner diameter of the pipe insertion portion, and a step may be formed between the connection insertion portion and the pipe insertion portion to form a stopping protrusion.

A protrusion protruding from the inlet and the outlet toward the connection insertion portion of the flange may be formed in the one side tank, and the protrusion may have an inside penetrated to allow the heat exchange medium to flow.

The one side tank and the flange may be coupled to each other by expanding an end of the protrusion in an outer radial direction in a state in which the protrusion is inserted into the connection insertion portion.

An expanded portion formed as the end of the protrusion expands in an outer radial direction may contact the stopping protrusion to be supported.

The heat exchanger may further include a connection member connecting the one side tank to the flange.

The connection member may be a rivet in which one longitudinal side thereof is coupled to the one side tank and the other longitudinal side thereof is coupled to the flange.

The connection member may be a caulking member in which, after one longitudinal side thereof is inserted into a groove formed in the one side tank, an end of the one side tank is deformed by an external force to form a horizontal protrusion and the other longitudinal side thereof is coupled to the flange.

The heat exchanger may further include a tubular coupling member in which one longitudinal side is inserted into the inlet or the outlet, and the other longitudinal side is expanded in a state of being inserted into the connection insertion portion of the flange to couple the one side tank and the flange to each other.

In another general aspect, a method for manufacturing a heat exchanger including a core including a plurality of tubes in which a heat exchange medium flows; a pair of headers provided on both sides of the core, each having a tube insertion hole and fluidly coupled to the plurality of tubes through the tube insertion hole; a pair of tanks coupled to the pair of headers, respectively, to form a pair of header tanks; an inlet provided on one side tank among the pair of header tanks to allow the heat exchange medium to flow into the one side tank therethrough and an outlet provided on one side tank among the pair of header tanks to allow the heat exchange medium to be discharged from the one side tank therethrough, at least one of the inlet and the outlet having a flat joining portion in which an outer wall of the one side tank has a flat shape; and a flange coupled to the inlet or the outlet in which the flat joining portion is formed, the flange including a tank joining portion joined to the inlet or the outlet, the tank joining portion having a flat shape corresponding to the flat joining portion, the method includes: S10) coupling the flange to at least one of the inlet and the outlet; and S20) melting and coupling the flange to the one side tank through brazing.

The flange may further include a pipe insertion portion into which a pipe is inserted and a connection insertion portion communicating with the pipe insertion portion and formed to pass through the flange, the one side tank may include a protrusion protruding from the inlet and the outlet toward the connection insertion portion of the flange, and in step S10), in a state in which the protrusion is inserted into the connection insertion portion, an end of the protrusion may be expanded in an outer radial direction to couple the one side tank and the flange to each other.

An inner diameter of the connection insertion portion may be formed to be smaller than an inner diameter of the pipe insertion portion, a step may be formed between the connection insertion portion and the pipe insertion portion to form a stopping protrusion, and in step S10), an expanded portion formed as the end of the protrusion expands in an outer radial direction may contact the stopping protrusion to be supported.

The heat exchanger may further include a rivet connecting the one side tank to the flange, wherein, in step S10), a longitudinal one side of the rivet may be coupled to the one side tank, and the other longitudinal side may be coupled to the flange to couple the one side tank and the flange to each other.

The heat exchanger may further include a caulking member connecting the one side tank to the flange and having one longitudinal side inserted into a groove formed in the one side tank and the other longitudinal side coupled to the flange, wherein, in step S10), after one longitudinal side of the caulking member is inserted into the groove formed in the one side tank, a horizontal projection may be formed at an end of the caulking member on the one side tank by applying an external force to couple the one side tank and the flange to each other.

The flange may further include a pipe insertion portion into which a pipe is inserted and a connection insertion portion communicating with the pipe insertion portion to pass through the flange, wherein the heat exchanger further includes a tubular coupling member in which one longitudinal side is inserted into the inlet or the outlet and the other longitudinal side is inserted into the connection insertion portion of the flange, wherein, in step S10), in a state in which one longitudinal side of the tubular coupling member is inserted into the inlet or the outlet and the other longitudinal side thereof is inserted into the connection insertion portion, the tubular coupling member may be expanded to couple the one side tank and the flange to each other.

An outer wall of the one side tank may be formed of a clad material, and in step S20), in a state in which the flange is coupled to the one side tank, the one side tank and the flange are brazed using the clad material of the outer wall of the one side tank.

Advantageous Effects

In the heat exchanger of the present invention according to the above configuration, since both the coupling surfaces of the tank and the flange have a flat shape, a separate cutting process for machining the coupling surface of the flange into a curved shape is not required.

In addition, since the coupling surfaces of the tank and the flange have a flat shape, a delamination due to tolerance does not occur, and thus the tank and the flange may be brazed more easily.

In addition, since a shape of the flange may be freely adjusted during an extrusion process, the shape of the flange may be optimized to minimize a material used to form the flange and reduce a weight of the flange.

BEST MODE

Figure 1:
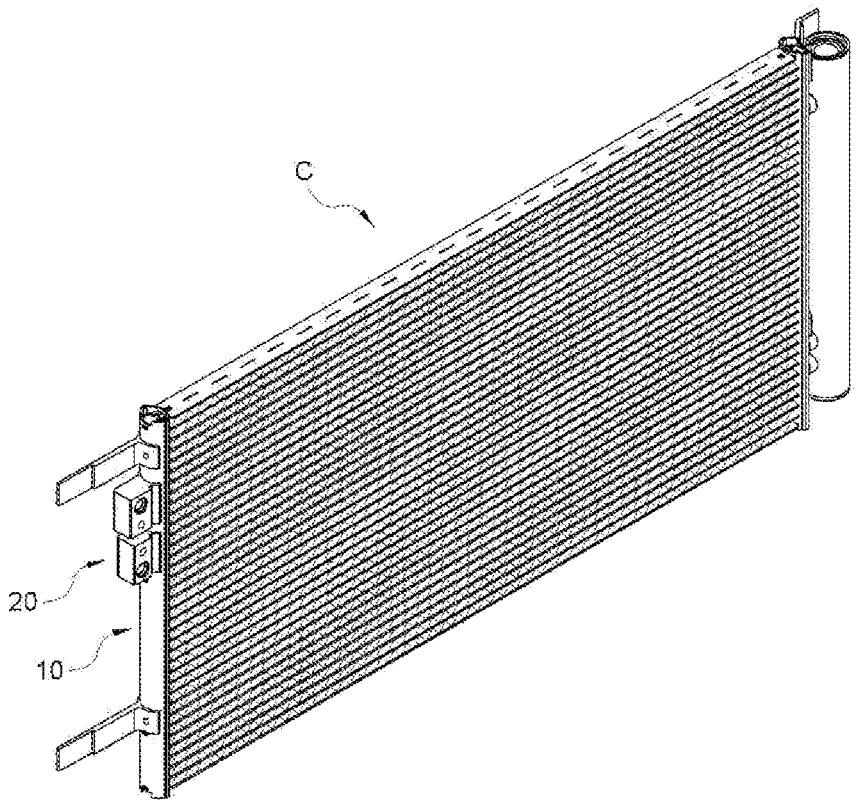
FIG. 1 is a perspective view showing a heat exchanger of the related art.

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art. Like reference numerals denote like elements throughout the description.

In the following description, when a detailed description of the relevant known function or configuration is determined to unnecessarily obscure the gist of the present disclosure, the detailed description will be omitted. The terms used henceforth are defined in consideration of the functions of the present disclosure, and may be altered according to the intent of a user or operator, or conventional practice. Therefore, the terms should be defined on the basis of the entire content of this specification.

Hereinafter, a heat exchanger according to the present invention as described above will be described in detail with reference to the accompanying drawings.

Figure 3:
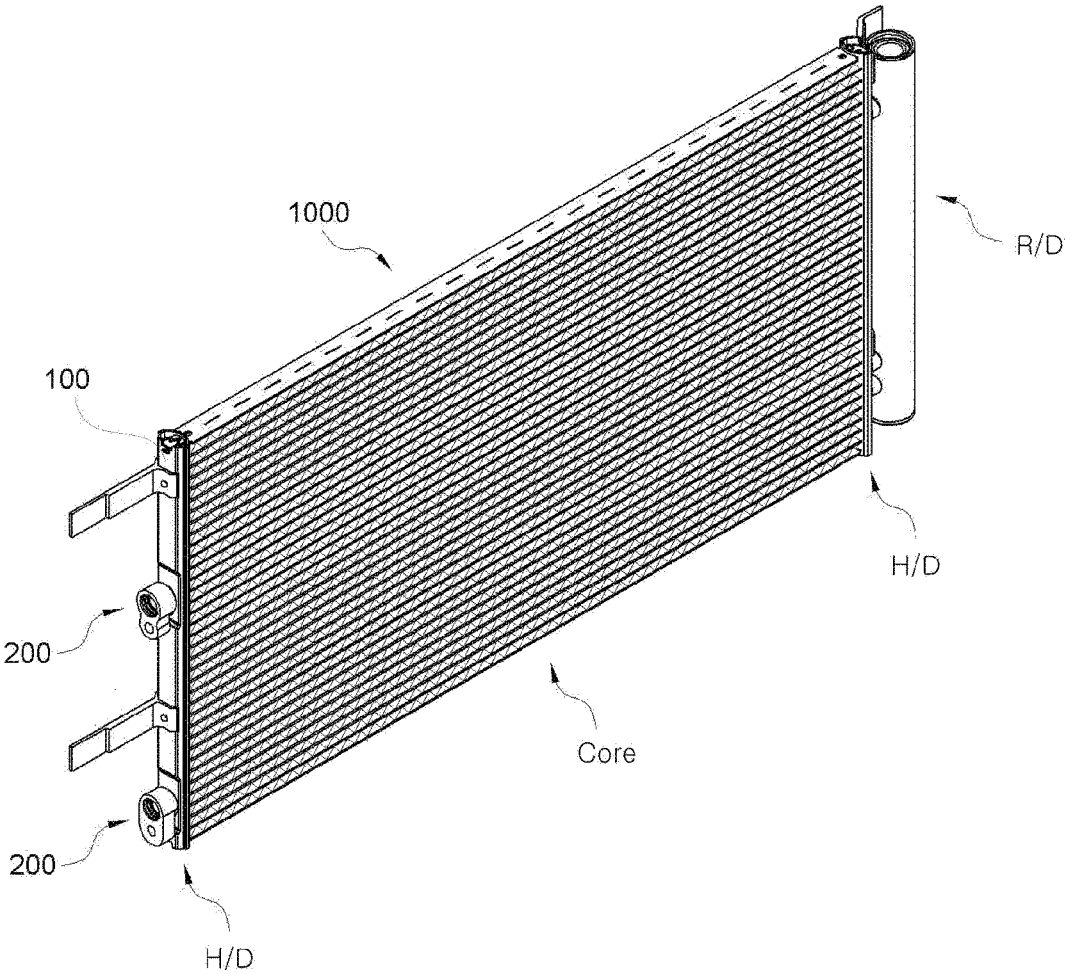
FIG. 3 is a perspective view of a heat exchanger according to an exemplary embodiment of the present invention.
Figure 4:
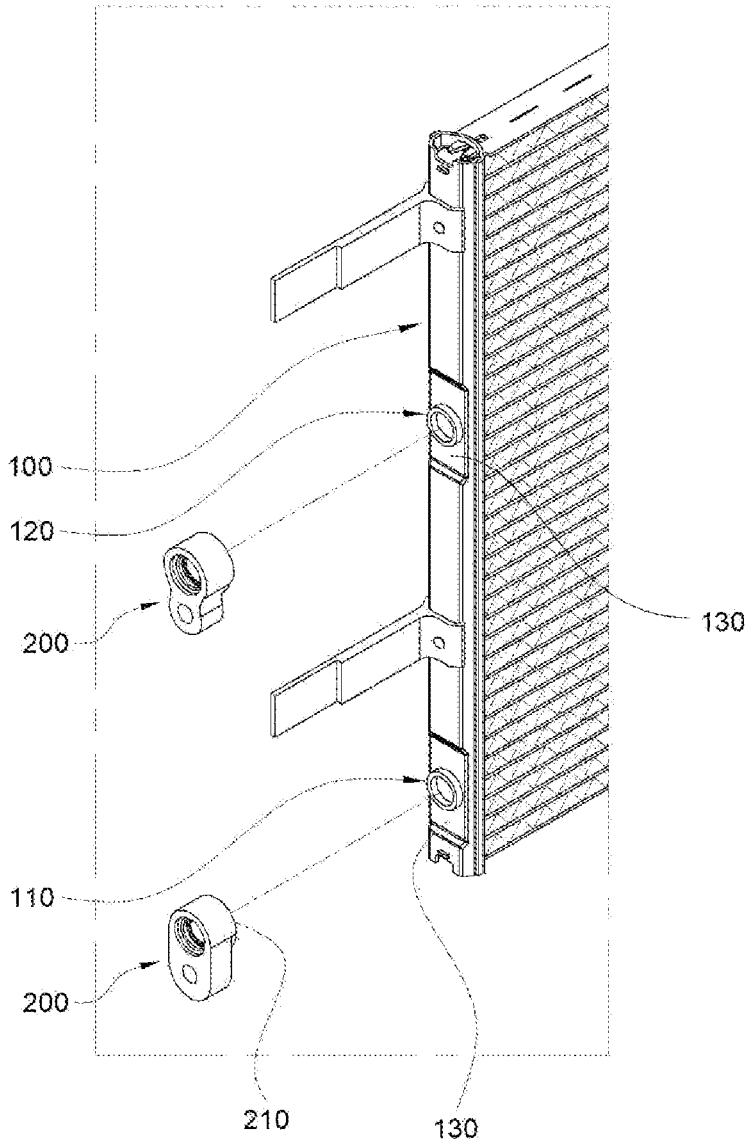
FIG. 4 is an enlarged view of one side tank and a flange according to an exemplary embodiment of the present invention.

FIG. 3 is a perspective view of a heat exchanger according to an exemplary embodiment of the present invention, and FIG. 4 is an enlarged view of one side tank and a flange according to an exemplary embodiment of the present invention.

First, a heat exchanger 1000 of the present invention may be a condenser. A heat exchanger is a device that absorbs heat from one side and discharges heat to the other side between two environments with a temperature difference. In general, a heat exchanger system includes an evaporator that absorbs heat from the surroundings, a compressor that compresses a heat exchange medium, a condenser that discharges heat to the surroundings, and an expansion valve that expands the heat exchange medium. Here, an evaporator or a condenser is a typical heat exchanger. A gaseous refrigerant flowing into the compressor from the evaporator is compressed to have a high temperature and high pressure in the compressor, and heat of liquefaction is discharged to the surroundings while the compressed gaseous refrigerant is liquefied, while passing through the condenser, and as the liquefied refrigerant passes through the expansion valve, the refrigerant turns to a low-temperature and low-pressure wet-saturated vapor state and then flows back into the evaporator to vaporize, thereby forming a cycle. That is, among the components of such a heat exchange system, the heat exchanger 1000 of the present invention may be a condenser. When the heat exchanger 1000 is a condenser, a receiver dryer may be further provided on one side to increase condensation efficiency, and in this case, an inlet and an outlet of a heat exchange medium may be provided in a tank of a header tank on the opposite side of a side where the receiver dryer is provided. However, the heat exchanger 1000 of the present invention is not limited to the condenser, and even if the heat exchanger is not a condenser, features related to the tank 100 and the flange 200 of the present invention to be described later may also be applicable.

As shown in FIG. 3, the heat exchanger 1000 of the present invention may include a core in which heat exchange is performed, a pair of header tanks H/D provided on both sides of the core, and a receiver dryer coupled to any one header tank, and in this case, an inlet through which a heat exchange medium flows into the header tank on the opposite side of the header tank to which the receiver dryer R/D is coupled and an outlet through which the heat exchange medium is discharged are formed, and a flange 200 may be coupled to each of the inlet and the outlet.

The core may include a plurality of tubes through which a heat exchange medium flows, and the header tank H/D may include a pair of headers provided on both sides of the core, respectively, and having a tube insertion hole to be fluidly coupled to a plurality of tubes through the tube insertion hole and a pair of tanks respectively coupled to the pair of headers to form the pair of header tanks.

Here, according to the present invention, any one side tank 100 of the pair of header tanks H/D may include an inlet 110 through which a heat exchange medium flows into the one side tank and an outlet 120 through which the heat exchange medium is discharged from one side tank, and a flat joining portion in which an outer wall of the one side tank has a flat shape may be formed in at least one of the inlet and the outlet.

Figure 2:
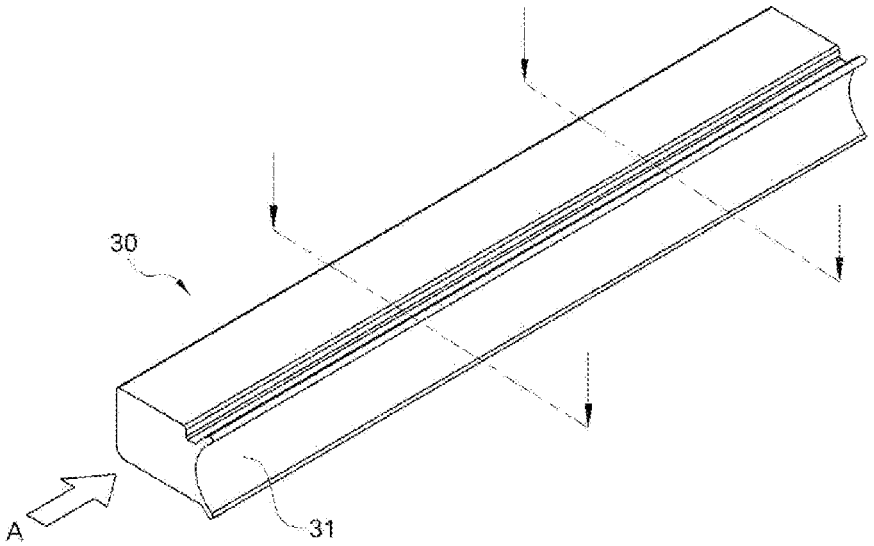
FIG. 2 is a view showing an extrusion direction of a flange of the related art.

Referring to FIG. 3, in the heat exchanger 1000 according to the present invention, the flange 200 is coupled to the one side tank 100 to allow the heat exchange medium to flow into the one side tank 100 or a pipe through which the heat exchange medium passing through the one side tank 100 is discharged and the tank 100 are connected, and coupling surfaces of the one side tank 100 and the flange 200 are recommended to have a flat shape. In detail, when the coupling surface of the tank to which the flange is coupled has a curved shape as described above with reference to FIGS. 1 and 2, the flange should also have a shape corresponding to the curved coupling surface of the tank, so the manufacturing process is complicated, and it is not easy to couple the tank with the flange, and there is also a problem that a shape of the flange cannot be freely adjusted during a flange extrusion molding process, and therefore, in the present invention, the coupling surfaces of the flange and the tank are formed to be flat, thereby resolving various problems.

FIG. 4 is a partially enlarged view for showing the coupling of the one side tank and the flange of the present invention, and as shown, the one side tank 100 has the inlet 110 through which a heat exchange medium is introduced and the outlet 120 through which the heat exchange medium passing through an internal flow path of the heat exchanger is discharged, and since the flange 200 is coupled to the inlet 110 and the outlet 120, the flat joining portion 130 having a flat shape is formed on one surface of the one side tank 100 to which the flange 200 is coupled, and thereafter, the inlet 110 and the outlet 120 are formed on the flat joining portion 130. Also, since the inlet 110, the outlet 120, and the flange 200 are brazed in a state of being in close contact with each other, a tank joining portion 210 having a flat shape corresponding to the flat joining portion 130 may be formed on one surface of the flange 200 facing the flat joining portion 130.

Figure 5:
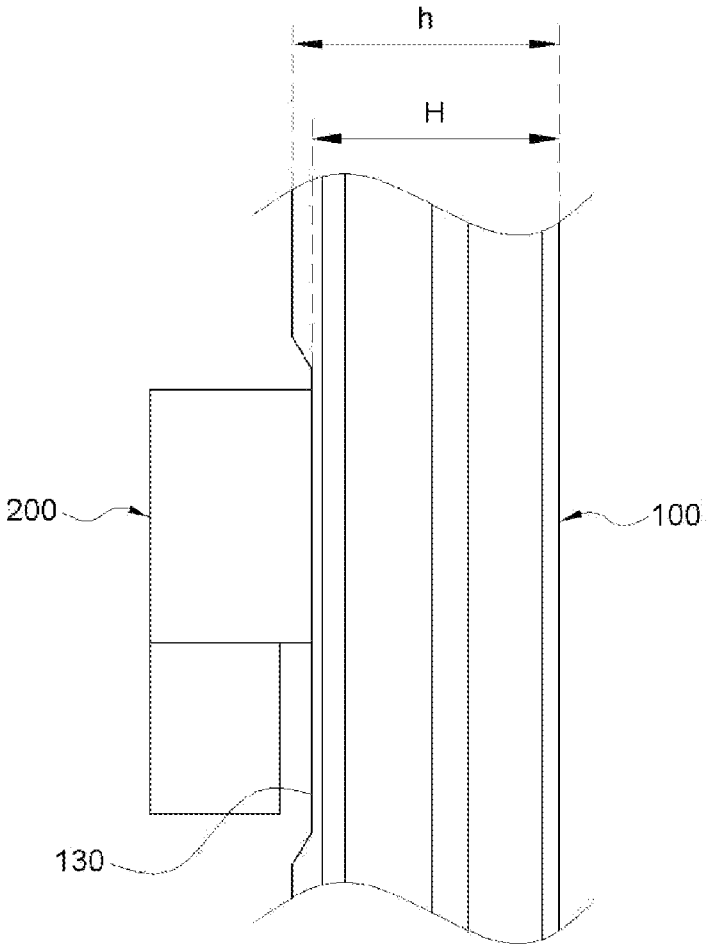
FIG. 5 is a side view in which a flange is coupled to one side tank according to an exemplary embodiment of the present invention.

FIG. 5 is a side view in which a flange is coupled to a one side tank according to an example of the present invention, in which, in the one-side tank 100, an area in which the flat joining portion 130 is formed is recessed in a direction in which the tube is coupled in the one side tank 100, so that a width directional length H of a region in which the flat joining portion 130 is formed is recommended to be shorter than a width directional length h of the other regions.

In detail, coupling of the tank and the flange is strengthened by minimizing an exposed portion of the flange 200 exposed to the outside, and when the shape of the outer circumferential surface of the tank is changed to a flat shape, durability of the tank may become weak, and thus, the width directional length H of a specific region of one side tank 100 in which the flat joining portion 130 is formed is formed to be shorter than the width directional length h of the other regions, thereby lowering pressure of the region in which the flat joining portion 130 is formed to be lower than pressure of the other regions.

Figure 6:
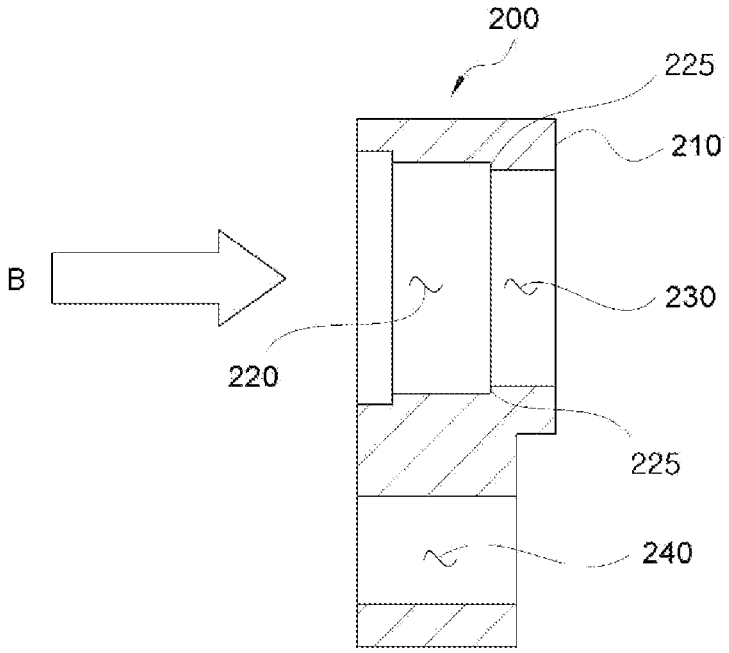
FIG. 6 is a side cross-sectional view of a flange according to an exemplary embodiment of the present invention.

FIG. 6 is a cross-sectional side view of a flange according to an exemplary embodiment of the present invention. Referring to FIG. 6, the flange 200 may further include a pipe insertion portion 220 to which a pipe is coupled and a screw coupling portion 230 to which a screw is coupled. The pipe insertion portion 220 and the screw coupling portion 230 may be formed in a direction B in which the flange 200 is extruded or forged.

In detail, as described above with reference to FIG. 2, in the related art, one surface of the flange had to have a curved shape corresponding to the curved shape of the tank, so a curved coupling surface 31 is formed on the side of the molded product 30 disposed perpendicular to an extrusion direction A, and thus, a hole cannot be drilled on the molded product 30 because a direction of the hole in which a pipe and a screw are coupled is different from a direction in which the molded product 30 is extruded. However, in the present invention, since a direction B in which the 200 is extruded and a direction in which the pipe insertion portion 220 and the screw coupling portion 230 are drilled are the same, a basic hole of the pipe insertion portion 220 and the screw coupling portion 230 may be drilled in the extrusion process. In addition, since a surface of the flange 200 cut after extrusion is used as a tank joining portion 210 coupled to the flat joining portion 130, a shape of the edge may be freely adjusted, thereby reducing a material used to form the flange 200 and minimizing a weight of the flange 200 through a shape optimization process. Furthermore, according to the present invention, since the tank joining portion 210 is formed of a flat surface, the flange 200 may be formed through forging as well as extrusion, and thus the flange 200 may be formed through forging to match the flat joining portion 130 of the tank 100.

Figure 7:
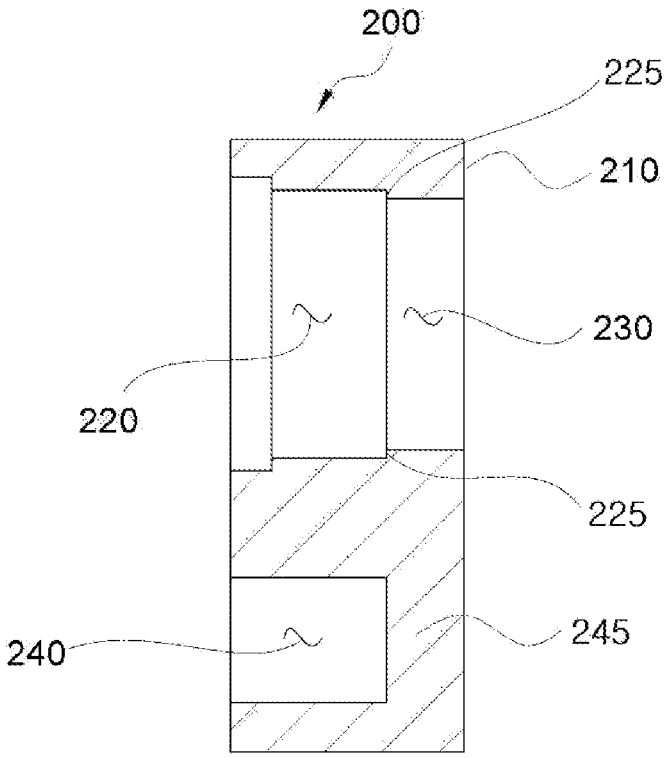
FIG. 7 is a side cross-sectional view of a flange according to another example of the present invention.

FIG. 7 is a side cross-sectional view of a flange according to another example of the present invention. Referring to FIGS. 6 and 7 in comparison, the flange 200 of the present invention may be classified into a first type in which the tank joining portion 210 is formed to be stepped, so that contact of the screw coupling portion 230 and the flat joining portion 130 is prevented as shown in FIG. 6 and a second type in which the screw coupling portion 240 is closed by a blocking portion 245 to prevent contact between the screw coupling portion 240 and the flat joining portion 130 as shown in FIG. 7.

In detail, as shown in FIG. 5, after the tank joining portion 210 of the flange 200 is in close contact with the flat joining portion 130 of the one side tank 100, the flat joining portion 130 and the tank joining portion 210 may be brazed to be melt-bonded to each other. At this time, when the screw coupling portion 230 is drilled, a weld material may fill the screw coupling portion 240, causing a problem in that a screw cannot be coupled to the screw coupling portion 240. Therefore, in the present invention, as shown in FIG. 6, the tank joining portion 210 has a step structure in which one longitudinal side on which the pipe insertion portion 220 protrudes relative to the other longitudinal side on which the screw coupling portion 240 is formed, thereby preventing inflow of a molded material to the screw coupling portion 240, or as shown in FIG. 7, the other longitudinal side of the screw coupling portion 220 is closed by the blocking portion 245 of the flange 200.

Meanwhile, as shown in FIGS. 6 and 7, the flange 200 of the present invention may further include a connection insertion portion 230 formed to pass through the flange 100 in communication with the pipe insertion portion 220, and here, an inner diameter of the connection insertion portion 230 is formed to be smaller than an inner diameter of the pipe insertion portion, and a step may be formed between the connection insertion portion and the pipe insertion portion to form a stopping protrusion 225.

FIGS. 8 to 12 show various coupling structures of one side tank and a flange, and each coupling structure will be described in detail below.

Figure 8:
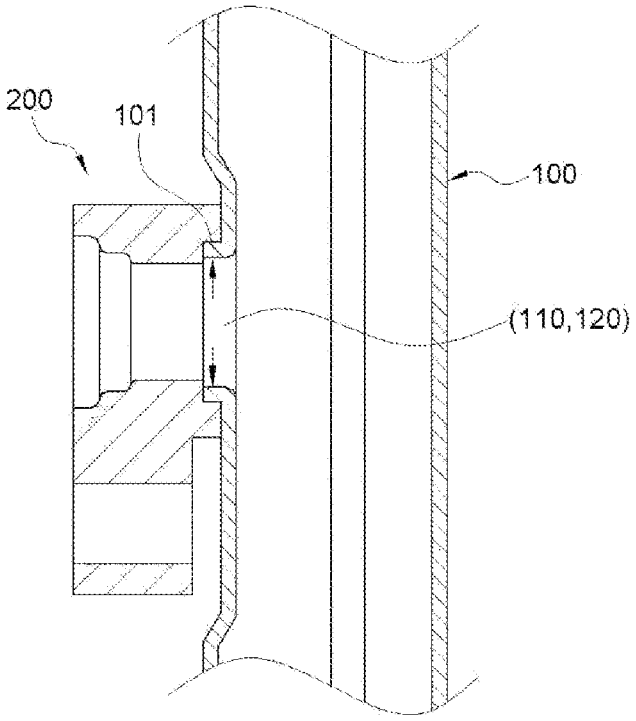
FIGS. 8 to 12 are side cross-sectional views showing a coupling structure of one side tank and a flange.

FIG. 8 shows a coupling structure of one side tank and the flange according to the first exemplary embodiment. According to this, a protrusion 101 is formed in the inlet 110 and the outlet 120 of the one side tank 100, which may be expanded in a state in which the protrusion 101 is inserted into the connection insertion portion 230 of the flange 200. In detail, the protrusion 101 surrounds the inlet 110 or the outlet 120 and has a shape protruding in a direction in which the flange 200 is coupled, and an inner center may be penetrated to allow the heat exchange medium to flow. Therefore, when expanding, in a state in which a burring portion 101 is inserted into the pipe connection portion 230, the burring portion 101 may open outward and come in close contact with the inner surface of the connection insertion portion 230, so that the flange 200 may be fixed to the one side tank 100. Expansion is a method of fixing a tube to a tube plate, and is a method of expanding a portion in contact with the tube plate of a tube end and tightly attaching it to a hole of the tube plate to fix the same, and according to the present invention, in a state in which the protrusion 101 is inserted into the connection insertion portion 230, an end of the protrusion 101 may be expanded in an outer radial direction to be in close contact with the inner surface of the connection insertion portion 230 to fix the flange 200 to the tank 100.

Figure 9:
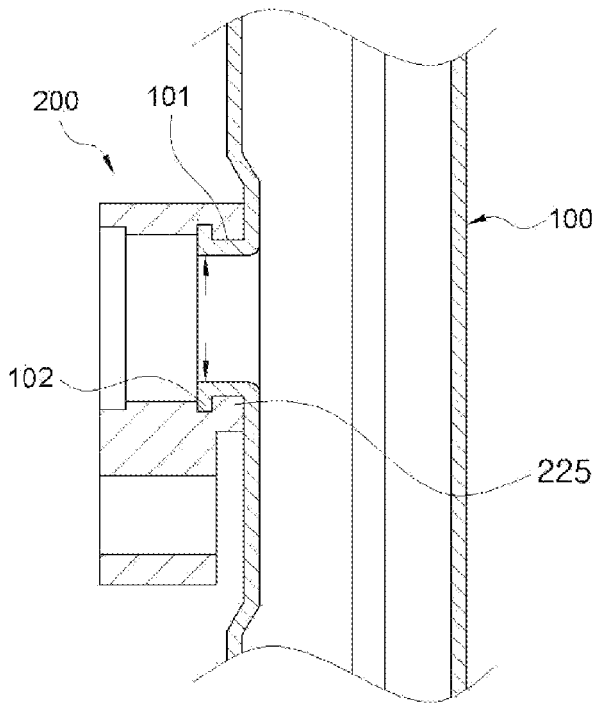

FIG. 9 shows a coupling structure of the one side tank and the flange according to a second exemplary embodiment. Meanwhile, at this time, a coupling structure according to the second exemplary embodiment may be a structure in which the stopping protrusion 225 is formed on an inner surface of the flange 200 and an expanded portion 102 formed as the protrusion 101 is expanded may be caught by the stopping protrusion 225 to couple the one side tank 100 and the flange 200 to each other. In detail, since the coupling between the tank and the flange may not be firmly achieved by simple expansion, the stopping protrusion 225 where the expanded portion, which is an enlarged end of the protrusion, is inserted and fixed is formed inside the flange during expansion, thereby strengthening the coupling of the tank and the flange.

Figure 10:
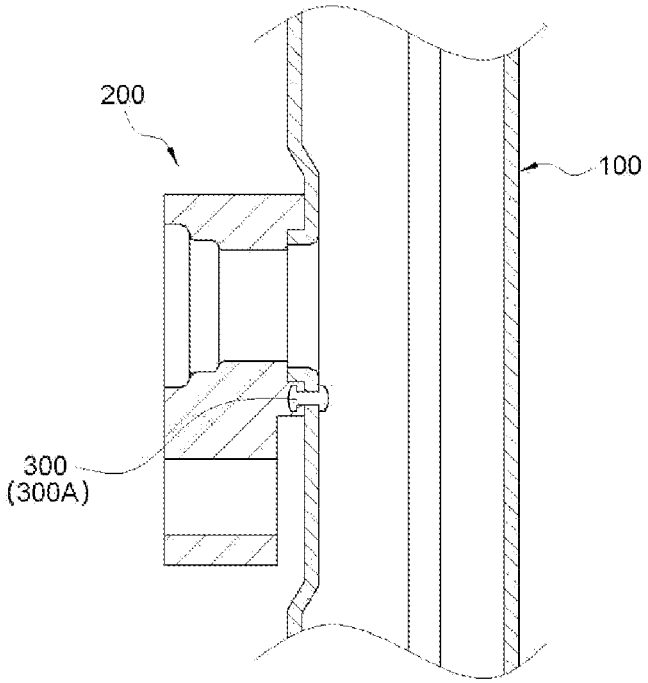

FIG. 10 shows a coupling structure of one side tank and the flange according to a third exemplary embodiment. According to this, the one side tank 100 and the flange 200 may be formed through a connection member 300, in which case the connection member 300 may be a rivet 300A. In detail, one head portion of the rivet 300A in a longitudinal direction is inserted and fixed in the tank 100 and the other head portion in the longitudinal direction is positioned on the flange 200 to couple the one side tank 100 and the flange 200 to each other.

Figure 11:
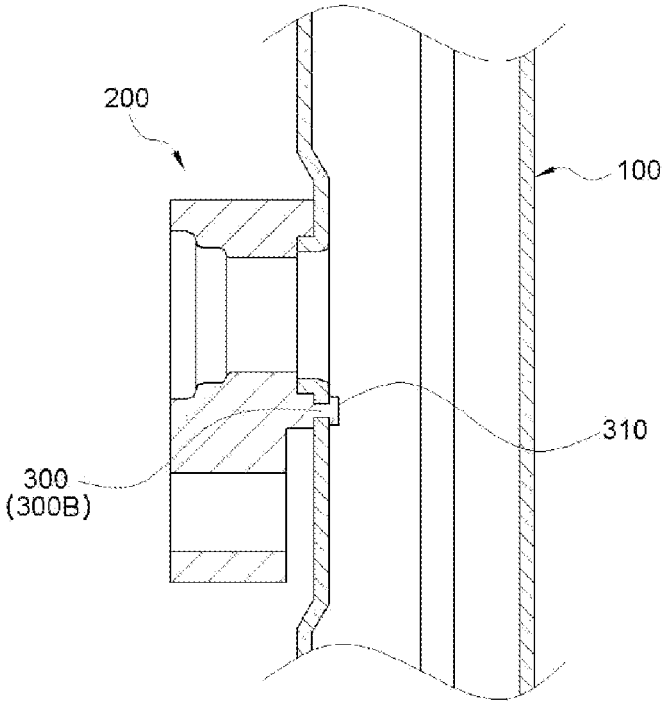

FIG. 11 shows a coupling structure of one side tank and the flange according to a fourth exemplary embodiment. According to this, the one side tank 100 and the flange 200 may be formed through the connection member 300, in which case the connection member 300 may be a caulking member 300B. In detail, after one longitudinal side of the caulking member 300B is coupled to the flange 200, and the other longitudinal side is inserted into a groove formed in the tank 100, an end portion is deformed by an external force to form a horizontal protrusion 310. As such, the horizontal protrusion 310 is formed on one side tank and caught to be coupled so that the one side tank and the flange may be coupled to each other.

Figure 12:
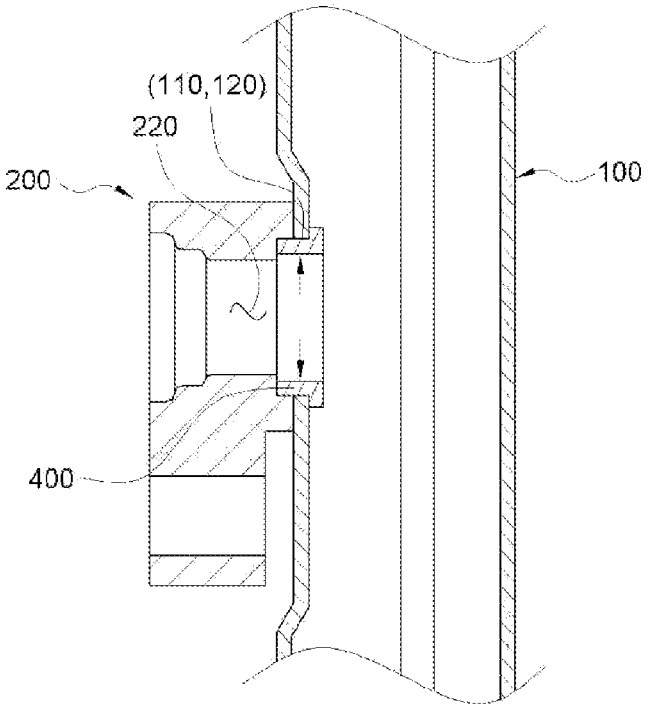

FIG. 12 is a view showing a coupling structure of the one side tank and the flange according to a fifth exemplary embodiment. According to this, the one side tank 100 and the flange 200 may be formed through a tubular coupling member 400. In detail, one longitudinal side of the tubular coupling member 400 having a flow path through which the heat exchange medium may pass is inserted into the inlet 110 or the outlet 120, and the other longitudinal side is inserted into the connection insertion portion 230, and the coupling member 400 may be expanded so that the tank 100 and the flange 200 are connected by the coupling member 400. Here, when the tubular coupling member 400 is expanded as described above, one end of the coupling member 400 inserted into the flange 200 may be expanded in an outer radial direction to be in close contact with an inner circumferential surface of the connection insertion portion 230 or caught by the stopping protrusion 225, and the other end of the coupling member 400 inserted into the inlet 110 or the outlet 120 may be expanded in the outer radial direction to be caught inside the one side tank 100 corresponding to the inlet 110 or the outlet 120.

Hereinafter, a method of manufacturing a heat exchanger according to another aspect of the present invention will be described.

A heat exchanger of the present method is the heat exchanger 1000 described above through FIG. 3 and may include a core including a plurality of tubes in which a heat exchange medium flows; a pair of headers provided on both sides of the core, each having a tube insertion hole and fluidly coupled to the plurality of tubes through the tube insertion hole; a pair of tanks coupled to the pair of headers, respectively, to form a pair of header tanks; an inlet provided on one side tank among the pair of header tanks to allow the heat exchange medium to flow into the one side tank therethrough and an outlet provided on one side tank among the pair of header tanks to allow the heat exchange medium to be discharged from the one side tank therethrough, at least one of the inlet and the outlet having a flat joining portion in which an outer wall of the one side tank has a flat shape; and a flange coupled to the inlet or the outlet in which the flat joining portion is formed, the flange including a tank joining portion joined to the inlet or the outlet, the tank joining portion having a flat shape corresponding to the flat joining portion.

The method may include, in such a heat exchanger, S10) coupling the flange to at least one of the inlet and the outlet; and S20) melting and coupling the flange to the one side tank through brazing.

First, in step S10, the tank joining portion formed of a plane of the flange contacts the inlet or the outlet where the flat joining portion of the one side tank is formed to mechanically couple the flange to the one side tank before the flange and the one side tank are melted and coupled through brazing, in which the coupling structure described above may be used.

Specifically, referring back to FIGS. 6 and 8, the coupling method according to the first exemplary embodiment of the present invention is as follows. The flange 200 further includes a pipe insertion portion 220 into which a pipe is inserted, and a connection insertion portion 230 that communicates with the pipe insertion portion and is formed to pass through the flange, and the one side tank 100 may have a protrusion 101 protruding toward the connection insertion portion 230 of the flange from the inlet 110 and the outlet 120 and penetrated so that the heat exchange medium may flow, and in this case, in step S10, in a state in which the protrusion 101 is inserted into the connection insertion portion 230, an end of the protrusion 101 may be expanded in an outer radial direction to couple the one side tank 100 and the flange 200 to each other.

Referring back to FIGS. 6 and 9, a coupling method according to the second exemplary embodiment of the present invention is as follows. An inner diameter of the connection insertion portion 230 may be formed to be smaller than an inner diameter of the pipe insertion portion 220, and a step may be formed between the connection insertion portion 230 and the pipe insertion portion 220 to form the stopping protrusion 225. In this case, in step S10, the expanded portion 102 formed as the end of the protrusion 101 in the outer radial direction may be supported in contact with the stopping protrusion 225.

Referring again to FIG. 10, a coupling method according to a third exemplary embodiment of the present invention is as follows. The present heat exchanger may further include a rivet 300A connecting the one side tank 100 and the flange 200, and here, in step S10, one longitudinal side of the rivet 300A may be coupled to the one side tank 100 and the other longitudinal side may be coupled to the flange 200 to couple the one side tank 100 and the flange 300A to each other.

Referring back to FIG. 11, a coupling method according to a fourth exemplary embodiment of the present invention is as follows. The heat exchanger may further include a caulking member 300B connecting the one side tank 100 and the flange 200 and having one longitudinal side inserted into a groove formed in the one side tank 100 and the other longitudinal side coupled to the flange 200. In this case, in step S10, a horizontal protrusion 310 may be formed at an end of the caulking member 300B adjacent to the one side tank 100 by applying an external force after inserting one longitudinal side of the caulking member 300B into the groove formed in the one side tank 100 to couple the one side tank 100 and the flange 200 to each other.

Referring back to FIGS. 6 and 12, a coupling method according to a fifth exemplary embodiment of the present invention is as follows. The flange 200 may further include a pipe insertion portion 220 into which a pipe is inserted and a connection insertion portion 230 that communicates with the pipe insertion portion and is formed to pass through the flange. The present heat exchanger may further include a tubular coupling member 400 having one longitudinal side inserted into the inlet 110 or the outlet 120 and the other longitudinal side inserted into the connection insertion portion 230 of the flange 200, and in step S10, in a state in which one longitudinal side of the tubular coupling member 400 is inserted into the inlet 110 or the outlet 120 and the other longitudinal side is inserted into the connection insertion portion 230, the tubular coupling member 400 may be expanded to couple the one side tank 100 and the flange 200 to each other. At this time, when the tubular coupling member 400 is expanded, one end of the coupling member 400 inserted into the flange 200 may be expanded in the outer radial direction to be in close contact with the inner circumferential surface of the connection insertion portion 230 or to be caught by the stopping protrusion 225 and the other end of the coupling member 400 inserted into the inlet 110 or the outlet 120 may be expanded in the outer radial direction to be caught on the inside of the one side tank 100 corresponding to the inlet 110 or the outlet 120.

The present invention may preferentially couple the flange to the one side tank in step S10 through these various coupling exemplary embodiments, and then melt-bond the flange and the one side tank through brazing in step S20.

Here, according to the present invention, an outer wall of one side tank may be formed of a clad material, and at this time, in step S20, one side tank and the flange may be brazed using the clad material of the outer wall of the one side tank in a state in which the flange is coupled to the one side tank.

As described above, according to the present invention, the tank and the flange are mechanically coupled through various coupling structures up to the stage before the brazing process, and then the clad material is melt-bonded to the tank using the clad material of the tank in the brazing process, thereby simplifying the overall manufacturing process of the heat exchanger.

The present invention should not be construed as being limited to the above-mentioned exemplary embodiment. The present invention may be applied to various fields and may be variously modified by those skilled in the art without departing from the scope of the present invention claimed in the claims. Therefore, it is obvious to those skilled in the art that these alterations and modifications fall within the scope of the present invention.

DETAILED DESCRIPTION OF MAIN ELEMENTS

1000: heat exchanger
H/D: header tank
Core: core
R/D: receiver dryer
100: one side tank
110: inlet
120: outlet
130: flat joining portion
101: protrusion
102: expanded portion
200: flange
210: tank joining portion
220: pipe insertion portion
225: stopping protrusion
230: connection insertion portion
240: screw coupling portion
245: blocking portion
300: connection member
300A, 300B: rivet, caulking member
310 horizontal projection
400: tubular coupling member

The invention claimed is:

1. A heat exchanger comprising:
a core including a plurality of tubes in which a heat exchange medium flows;
a pair of headers provided on both sides of the core, each having a tube insertion hole and fluidly coupled to the plurality of tubes through the tube insertion hole; and
a pair of tanks coupled to the pair of headers, respectively, to form a pair of header tanks,
wherein one side tank of the pair of header tanks includes an inlet through which the heat exchange medium flows into the one side tank and an outlet through which the heat exchange medium is discharged from the one side tank, and
at least one of the inlet and the outlet has a flat joining portion in which an outer wall of the one side tank has a flat shape,
wherein the flat joining portion of the one side tank is formed to be concave toward a header coupled to the one side tank, rather than an outer wall of the one side tank in a remaining region, except for the flat joining portion, in the one side tank.

2. The heat exchanger of claim 1, further comprising:
a flange coupled to the inlet or the outlet on which the flat joining portion is formed,
wherein the flange includes a tank joining portion joined to the inlet or the outlet, and the tank joining portion has a flat shape corresponding to the flat joining portion.

3. The heat exchanger of claim 1, wherein
the flat joining portion of the one side tank is formed to be concave toward a header coupled to the one side tank, rather than an outer wall of the one side tank in a remaining region, except for the flat joining portion, in the one side tank.

4. The heat exchanger of claim 2, wherein
the flange includes a pipe insertion portion into which a pipe is inserted, and the pipe insertion portion is formed in a direction in which the flange is extruded or forged.

5. The heat exchanger of claim 4, wherein
the flange further includes a screw coupling portion to which a screw is coupled, and the screw coupling portion is formed in a direction in which the flange is extruded or forged.

6. The heat exchanger of claim 5, wherein
the flange has a structure in which one longitudinal side in which the pipe insertion portion is formed protrudes relative to the other longitudinal side in which the screw coupling portion is formed.

7. The heat exchanger of claim 5, wherein
the flange includes a blocking portion closing one longitudinal side of the screw coupling portion facing the flat joining portion.

8. The heat exchanger of claim 4, wherein
the flange further includes a connection insertion portion communicating with the pipe insertion portion and passing through the flange.

9. The heat exchanger of claim 8, wherein
an inner diameter of the connection insertion portion is formed to be smaller than an inner diameter of the pipe insertion portion, and a step is formed between the connection insertion portion and the pipe insertion portion to form a stopping protrusion.

10. The heat exchanger of claim 9, wherein
a protrusion protruding from the inlet and the outlet toward the connection insertion portion of the flange is formed in the one side tank, and the protrusion has an inside penetrated to allow the heat exchange medium to flow.

11. The heat exchanger of claim 10, wherein
the one side tank and the flange are coupled to each other by expanding an end of the protrusion in an outer radial direction in a state in which the protrusion is inserted into the connection insertion portion.

12. The heat exchanger of claim 11, wherein
an expanded portion formed as the end of the protrusion expands in an outer radial direction contacts the stopping protrusion to be supported.

13. The heat exchanger of claim 8, wherein
the heat exchanger further includes a connection member connecting the one side tank to the flange.

14. The heat exchanger of claim 13, wherein
the connection member is a rivet in which one longitudinal side thereof is coupled to the one side tank and the other longitudinal side thereof is coupled to the flange.

15. The heat exchanger of claim 13, wherein
the connection member is a caulking member in which, after one longitudinal side thereof is inserted into a groove formed in the one side tank, an end of the one side tank is deformed by an external force to form a horizontal protrusion and the other longitudinal side thereof is coupled to the flange.

16. The heat exchanger of claim 8, wherein the heat exchanger further includes a tubular coupling member in which one longitudinal side is inserted into the inlet or the outlet, and the other longitudinal side is expanded in a state of being inserted into the connection insertion portion of the flange to couple the one side tank to the flange.

17. A method for manufacturing a heat exchanger including a core including a plurality of tubes in which a heat exchange medium flows; a pair of headers provided on both sides of the core, each having a tube insertion hole and fluidly coupled to the plurality of tubes through the tube insertion hole; a pair of tanks coupled to the pair of headers, respectively, to form a pair of header tanks; an inlet provided on one side tank among the pair of header tanks to allow the heat exchange medium to flow into the one side tank therethrough and an outlet provided on one side tank among the pair of header tanks to allow the heat exchange medium to be discharged from the one side tank therethrough, at least one of the inlet and the outlet having a flat joining portion in which an outer wall of the one side tank has a flat shape; and a flange coupled to the inlet or the outlet in which the flat joining portion is formed, the flange including a tank joining portion joined to the inlet or the outlet, the tank joining portion having a flat shape corresponding to the flat joining portion, the method comprising:

S10) coupling the flange to at least one of the inlet and the outlet; and

S20) melting and coupling the flange to the one side tank through brazing, wherein the flange further includes a pipe insertion portion into which a pipe is inserted and a connection insertion portion communicating with the pipe insertion portion and formed to pass through the flange, the one side tank includes a protrusion protruding from the inlet and the outlet toward the connection insertion portion of the flange, and in the melting and coupling step, in a state in which the protrusion is inserted into the connection insertion portion, an end of the protrusion is expanded in an outer radial direction to couple the one side tank to the flange.

18. The heat exchanger of claim 17, wherein the flange further includes a pipe insertion portion into which a pipe is inserted and a connection insertion portion communicating with the pipe insertion portion and formed to pass through the flange, the one side tank includes a protrusion protruding from the inlet and the outlet toward the connection insertion portion of the flange, and in step S10), in a state in which the protrusion is inserted into the connection insertion portion, an end of the protrusion is expanded in an outer radial direction to couple the one side tank to the flange.

19. The heat exchanger of claim 18, wherein an inner diameter of the connection insertion portion is formed to be smaller than an inner diameter of the pipe insertion portion, a step is formed between the connection insertion portion and the pipe insertion portion to form a stopping protrusion, and in step S10), an expanded portion formed as the end of the protrusion expands in an outer radial direction contacts the stopping protrusion to be supported.

20. The heat exchanger of claim 17, further comprising:

a rivet connecting the one side tank to the flange, wherein, in step S10), a longitudinal one side of the rivet is coupled to the one side tank, and the other longitudinal side is coupled to the flange to couple the one side tank to the flange.

21. The heat exchanger of claim 17, further comprising:

a caulking member connecting the one side tank to the flange and having one longitudinal side inserted into a groove formed in the one side tank and the other longitudinal side coupled to the flange, wherein, in step S10), after one longitudinal side of the caulking member is inserted into the groove formed in the one side tank, a horizontal projection is formed at an end of the caulking member on the one side tank by applying an external force to couple the one side tank to the flange.

22. The heat exchanger of claim 17, wherein the flange further includes a pipe insertion portion into which a pipe is inserted and a connection insertion portion communicating with the pipe insertion portion to pass through the flange, wherein the heat exchanger further includes a tubular coupling member in which one longitudinal side is inserted into the inlet or the outlet and the other longitudinal side is inserted into the connection insertion portion of the flange, wherein, in step S10), in a state in which one longitudinal side of the tubular coupling member is inserted into the inlet or the outlet and the other longitudinal side thereof is inserted into the connection insertion portion, the tubular coupling member is expanded to couple the one side tank to the flange.

23. The heat exchanger of claim 17, wherein an outer wall of the one side tank is formed of a clad material, and in step S20), in a state in which the flange is coupled to the one side tank, the one side tank and the flange are brazed using the clad material of the outer wall of the one side tank.

* * * * *